United States Patent [19]

Abu-Moustafa et al.

[11] Patent Number: 4,539,044

[45] Date of Patent: Sep. 3, 1985

[54] ELECTROLESS COPPER PLATING

[75] Inventors: Magda Abu-Moustafa, Lexington; Silvester P. Valayil, Shrewsbury, both of Mass.

[73] Assignee: Shipley Company Inc., Newton, Mass.

[21] Appl. No.: 650,872

[22] Filed: Sep. 17, 1984

Related U.S. Application Data

[63] Continuation of Ser. No. 441,742, Nov. 15, 1982, abandoned.

[51] Int. Cl.[3] ..... C23C 3/02

[52] U.S. Cl. ..... 106/1.23; 106/1.26

[58] Field of Search ..... 106/1.23–1.26

[56] References Cited

U.S. PATENT DOCUMENTS 3,728,137 4/1973 Shipley et al. ..... 106/1.23

4,171,225 10/1979 Molenaar et al. ..... 106/1.23

*Primary Examiner*—Lorenzo B. Hayes

*Attorney, Agent, or Firm*—Robert L. Goldberg

[57] ABSTRACT

An electroless copper plating solution containing, in aqueous medium, cupric ions, hydroxyl radicals, complexing agent for cupric ions, formaldehyde and a formaldehyde addition agent; wherein the molar ratio of each of copper and free formaldehyde to hydroxyl radical is between 1 to 10 and 1 to 40.

9 Claims, No Drawings

ELECTROLESS COPPER PLATING

This is a continuation of application Ser. No. 06/441,742 filed Nov. 15, 1982 now abandoned.

BACKGROUND OF THE INVENTION

1. Introduction

This invention relates to a metal depositing composition and more particularly, to a non-fuming electroless copper plating solution.

2. Description of the Prior Art

Electroless copper deposition refers to the chemical plating of copper over a clean, catalytically active surface, by chemical reduction in the absence of an external electric current. Such processes, and compositions useful therefor, are known and are in substantial commercial use. They are disclosed in a number of prior art patents, for example, U.S. Pat. Nos. 3,663,242; 3,728,137; 3,846,138; and 4,229,218, all incorporated herein by reference.

Known electroless copper deposition solutions generally comprise four ingredients dissolved in water. They are (1) a source of cupric ions, usually a copper salt such as copper sulphate, (2) a reducing agent such as formaldehyde, or preferably a formaldehyde precursor such as paraformaldehyde, (3) hydroxide, generally an alkali metal hydroxide and usually sodium hydroxide, sufficient to provide the required alkalinity necessary for said compositions to be effective, and (4) a complexing agent for copper sufficient to prevent its precipitation in alkaline solution. A large number of complexing agents are known and described in the aforesaid cited patents and elsewhere.

Known electroless copper plating solutions of the above type frequently provide a plate which, if mechanically dense and strong, is brittle such that it can withstand limited bending or thermal stress without fracture. This is not a substantial disadvantage where the electroless plate is of the order of millionths of an inch in thickness and is overplated with ductile electrolytic copper. However, where the entire desired thickness is provided by electroless plating, i.e., typically one to three mils in electrical fabrication such as in the manufacture of printed circuit boards by additive techniques, limited ductility is a serious limitation.

One means of improving the bending or tensile characteristics of an electroless copper plate is described in U.S. Pat. No. 3,213,430 which discloses the addition to the copper plating solution of a water soluble compound of cyanide, vanadium, molybdenum, niobium, tungsten, rhenium, arsenic, antimony, bismuth, rare earths of the actinium series and rare earths of the lanthanum series. Certain members of the above groups, especially the vanadium compounds, provide improved bending characteristics. The reason for this is not fully understood, but it is stated in the patent that the agents act on the catalytic surface so as to prevent formation and release of hydrogen gas, thereby inhibiting the inclusion of hydrogen in the deposit as it forms. It has been found that where a complexing agent or a bath formulation is used permitting rapid deposition of copper with rapid evolution of hydrogen gas at the surface, the improved ductility or bending characteristics are frequently sacrificed or lost.

An additional method for improving the bending or tensile characteristics of a copper plate is disclosed in U.S. Pat. No. 3,728,137 noted above. In this patent, the copper solution is characterized by the addition of a formaldehyde addition agent to the solution which is believed to be responsible for forming an unstable addition product with formaldehyde. Because of the formation of the addition product with formaldehyde, it is theorized by the patentee that formaldehyde is slowly released into solution thereby reducing the evolution of hydrogen gas at the surface of the part being plated resulting in copper deposits having improved bending or tensile properties.

Though the improvement is obtained as noted in said patent, some free formaldehyde is still found in the bath at all times as a consequence of a breakdown of the addition product. This free formaldehyde is released from solution as a vapor which is dangerous to health and must be removed from the atmosphere, though the release of this formaldehyde to the atmosphere is decreased from that normally encountered absent the addition agent.

STATEMENT OF THE INVENTION

The invention herein is an improvement over that of the aforesaid U.S. Pat. No. 3,728,137 in that the desirable deposit properties are maintained and in many instances improved, but free formaldehyde is analytically absent from solution. The elimination of formaldehyde is accomplished by operating the solution at a pH of at least 11, while controlling the ratios of each of the free formaldehyde in solution and copper, to the hydroxide content in solution.

Because free formaldehyde is analytically absent from solution during plating, formaldehyde fuming from the solution is eliminated lessening the health hazard caused by formaldehyde in the air. This decreases the need to rely upon expensive exhaust equipment.

It has been found that the absence of free formaldehyde in solution may effect initiation of plating from a fresh solution and a minor amount of free formaldehyde may have to be added to start the plating reaction. This free formaldehyde is quickly consumed and once plating is initiated, the addition product provides adequate formaldehyde for continued plating. Consequently, the addition of the free formaldehyde initially appears to act as a catalytic initiator for plating, but as formaldehyde is consumed during the plating reaction, the formaldehyde required for continued plating is released and immediately consumed, with the concentration of the formaldehyde in solution during plating essentially 0.

DESCRIPTION OF THE PREFERRED EMBODIMENTS

Any water soluble copper salt heretofore used for preparing electroless copper deposition solutions may be used for the solutions of this invention. For example, the halides, nitrate, acetate, sulphates and other organic and inorganic acid salts of copper are generally suitable as is known in the art. Copper sulphate is preferred.

Suitable complexing agents for the copper ions are also well known in the art and include Rochelle salts, the sodium salts of ethylenediamine tetraacetic acid, nitrilotriacetic acid and its alkali metal salts, triethanolamine, modified ethylenediamine tetraacetic acids such as N-hydroxyethylenediamine triacetate, hydroxyalkyl substituted dialkaline triamines such as pentahydroxypropyldiethylenetriamine, and the like. A preferred class of complexing agents are those described in U.S. Pat. No. 3,329,512 and include hydroxylalkyl substituted tertiary amines such as tetrahydroxypropylethylene diamine, pentahydroxypropyldiethylene triamine, trihydroxypropyl amine (tripropanolamine), trihydroxypropyl hydroxyethyl ethylene diamine, etc.

The rate of copper deposition is, to some extent, dependent upon the selection of the complexing agent. Complexing agents such as pentahydroxypropyldiethylene triamine provide a reasonably fast rate of copper deposition, usually in excess of 1 mil per hour. Though the copper solutions of this invention provide copper deposits from solutions containing any of the known complexing agents for copper ions, they are particularly well adapted for copper solutions having complexing agents that provide a more rapid rate of copper deposition and which themselves provide more ductile deposits.

The formaldehyde addition agent, for purposes of this invention, is one that reacts with formaldehyde to form a relatively stable formaldehyde adduct and which may be added in sufficient concentration without poisoning the solution. Reactions of this nature and formaldehyde addition agents are well known in the art and are described in various publications such as "Formaldehyde" by J. Frederick Walker, Reinhold Publishing Company, 3rd Edition, 1964, Pages 219 to 221, included herein by reference. Preferred formaldehyde addition agents are sulfites, bisulfites, nitrites and phosphites of a metal having a cation noninterfering with the copper solution and preferrably an alkali metal cation. The most preferred formaldehyde addition agents are sodium sulfite, sodium or potassium bisulfite and sodium phosphite.

The formaldehyde addition agent and formaldehyde, or preferrably paraformaldehyde, are reacted with each other to form the adduct prior to addition to the remaining components of the copper solution as in the aforesaid U.S. Pat. No. 3,728,137. The amount of formaldehyde addition agent used may be less than or in molar excess of the amount of formaldehyde required for the solution, ranging from about 0.5 to 3.0 moles per mole of formaldehyde, though the addition agent is preferably used in amounts of from 0.8 to 1.2 moles per mole of formaldehyde, and more preferably, in amounts equimolar with the formaldehyde, it being understood that amounts of addition agent in excess of the formaldehyde are preferred to amounts less than the amount of formaldehyde.

The total formaldehyde content in solution, inclusive of free formaldehyde added to initiate the plating reaction and formaldehyde contained in the addition product is substantially as in the prior art. In this regard, the total formaldehyde content in solution is at least equimolar with the metal content in solution and preferrably, in substantial excess of the metal ion content in solution. Preferrably, the total formaldehyde content is at least 2 moles per mole of dissolved metal, preferrably varies between about 3 and 15 moles of formaldehyde per mole of dissolved metal and most preferrably, ranges between about 5 and 10 moles of formaldehyde per mole of dissolved metal.

The hydroxide content and pH for the solutions of the invention are higher than those generally used in the prior art. For example, where pH typically varies between 9 and 10.5 in prior art plating solutions, the solutions of this invention employ a pH of at least 11, preferably a pH ranging between 11 and 14, and more preferably, between 11.5 and 12.5. High hydroxide content forces the reaction of the formaldehyde and the addition agent to the right thereby maintaining the solution analytically free of formaldehyde.

Important to the elimination of free formaldehyde is the molar ratio of copper content and free formaldehyde content prior to initiating plating, each to hydroxide content. In this respect, the ratio of each to the hydroxide may vary between about 1 to 10 and 1 to 40 and preferably varies between about 1 to 12 and 1 to 25.

Take-off, i.e., the time for initial deposition of copper from a fresh plating solution formulated in accordance with this invention is slow because the formaldehyde is tightly bound to the addition agent at the high pH. Therefore, it is desirable that a small amount of free formaldehyde be added to a fresh plating solution to initiate deposition. This free formaldehyde is used in an amount of from 0.01 to 0.05 moles per liter of solution. It is consumed as deposition proceeds and it cannot be analytically detected during use of the plating solution.

The plating baths of this invention may be used at widely varying temperatures, e.g., at least room temperature and preferably up to about 140° F. As temperature is increased, it is customary to find an increase in the rate of plating. Temperature is not critical and within usual operating ranges, electroless copper deposits having excellent tensile properties are obtained.

In using the electroless copper solution to plate metal, the surface to be plated should be catalytically active and free of grease and contaminating materials as is known in the art. Where a non-metallic surface is to be plated, the surface area to receive the deposit must first be sensitized to render it catalytically active as by the well known treatment with the product of admixture of stannous chloride and a precious metal chloride, particularly palladium chloride, the stannous chloride being present in molar excess of the precious metals chloride. Such catalysts are disclosed in U.S. Pat. No. 3,011,920, incorporated herein by reference.

The invention will be better understood by reference to the following examples where all parts were placed using the following procedure:

(a) Cut a phenolic substrate to a size of 2" by 2";

(b) Scrub part clean using an abrasive cleaner;

(c) Rinse with cold water;

(d) Immerse in a solution of a wetting agent identified as Shipley Conditioner 1175 at 150° to 160° F. for three to five minutes;

(e) Rinse in cold water;

(f) Immerse in a stannic acid-palladium catalyst (identified as Cuposit Catalyst 44) maintained at 110° to 120° F. for three to five minutes;

(g) Rinse in cold water;

(h) Immerse in Cuposit Accelerator 19 maintained at room temperature for five to seven minutes;

(i) Rinse in cold water;

(j) Immerse in an electroless copper solution of this invention maintained at between 110° and 130° F. for a period sufficient to provide a deposit of 100 millionths of an inch;

(k) Dry parts and examine deposits for appearance and ductility. Ductility is determined by peeling a copper deposit from the substrate and bending it through 180° in one direction, creasing at the fold, then returning it to its original position with pressing along the crease to flatten it. This cycle constitutes one bend. The procedure is repeated until the sample breaks at the crease. A sample unable to withstand at least ½ bend is considered brittle.

EXAMPLE 1

| | |
|---|---|
| Cupric sulfate pentahydrate (gm) | 10 |
| Addition product (ml) | 40 |
| Pentahydroxylpropyl-diethylenetriamine (gm) | 30 |
| Sodium hydroxide (50% solution-ml) | 40 |
| Water | to 1 liter |

In the above example, the addition product was preformed by mixing 18 grams of sodium meta bisulfite and 7 grams of paraformaldehyde in 40 ml of water and adding the solution of the adduct to the plating bath.

Plating from the above formulation was initiated by adding 0.9 gms of formaldehyde to a made up bath. The formulation yielded a copper deposit of 100 millionths of an inch in thickness within a period of time of 30 minutes at 120° F. The deposit was able to withstand 6 bends.

The formulation was analyzed initially following the addition of the paraformaldehyde and after 4 hours of continuous use, and though the 0.9 grams of paraformaldehyde were detected following its addition, no free formaldehyde was detected after the four hour plating time.

EXAMPLE 2

| | |
|---|---|
| Cupric sulfate pentahydrate (gm) | 10 |
| Addition product (ml) | 40 |
| Pentahydroxypropyldiethylene triamine (gm) | 30 |
| Trihydroxypropyl amine (gm) | 20 |
| Sodium hydroxide (50% solution-ml) | 40 |
| Water to | 1 liter |

EXAMPLE 3

| | |
|---|---|
| Cupric Sulfate Pentahydrate (gm) | 10 |
| Addition product (ml) | 40 ml |
| Ethylenediaminetetraacetic acid (gm) | 35 |
| Sodium hydroxide (50% solution-ml) | 40 |
| Water to | 1 liter |

Solutions of Examples 2 and 3 performed in a manner similar to that of Example 1. Thereafter, Example 1 was repeated with the hydroxide content lowered to 9 ml. Formaldehyde fumes were readily detectable throughout a 4 hour plating sequence.

Copper solutions of this invention find utility for all purposes for which electroless copper solutions have heretofore been used including decorative and electrical applications. They are especially useful for the formation of printed circuit boards where the deposit acts as ductile conductors and as ductile connectors plated onto the walls of through-holes. The formation of a printed circuit board with conductive through-holes is illustrated in the following example.

EXAMPLE 4

(a) Scrub clean copper on a copper clad epoxy circuit board base material and etch to activate the copper.

(b) Drill through-holes at desired locations.

(c) Immerse in a one-step palladium sensitizing solution maintained at room temperature for a period of five minutes.

(d) Silk screen a reverse image of a printed circuit board pattern onto the roughened surface of the phenolic substrate using an epoxy plating resist and dry.

(e) Deposit electroless copper from the solution of Example 1 with copper deposition taking place on the walls of the through-holes and on the exposed copper of the cladding. No copper deposition should take place on the epoxy resist.

(f) Plating electrolytic solder onto the exposed copper conductors.

(g) Remove the plating resist.

(h) Immerse in a stripping solution of 10 grams of copper chloride, 100 grams of 37% hydrochloric acid and water to 1 liter maintained at room temperature for six minutes to remove exposed copper.

We claim:

1. An electroless copper plating solution comprising dissolved copper, hydroxide, sufficient complexing agent for the dissolved copper to render the same soluble in alkaline solution and an adduct comprising the reaction product of formaldehyde and a formaldehyde addition agent, said solution having a pH of at least 11 and a molar ratio of each of copper and free formaldehyde to hydroxide varying between 1 to 10 and 1 to 40.

2. The solution of claim 1 where the pH of the solution varies between 11 and 14.

3. The solution of claim 1 where the pH of the solution varies between 11.5 and 12.5.

4. The solution of claim 1 where the ratios of copper and free formaldehyde to hydroxide vary between 1 to 12 and 1 to 25.

5. The solution of claim 1 where the adduct is formed before addition to the copper plating solution.

6. The solution of claim 1 where the addition agent is selected from the group of salts of sulphites, bisulphites, nitrites and phosphites, said salt having a cation non-interfering with the plating solution.

7. The solution of claim 6 where the formaldehyde addition agent is a bisulfite.

8. A process for initiating plating from a freshly prepared electroless copper plating solution comprising a source of dissolved copper, hydroxide, complexing agent for the dissolved copper in an amount sufficient to render the same soluble in alkaline solution and an adduct comprising the reaction product of formaldehyde and a formaldehyde addition agent, said solution having a pH of at least 11 and a molar ratio of each of copper and free formaldehyde to hydroxide varying between 1 to 10 and 1 to 40, said process comprising adding free formaldehyde to the solution in an amount sufficient to initiate deposition.

9. The process of claim 8 where the concentration of free formaldehyde added to the solution varies between about 0.01 to 0.05 moles per liter of solution.

* * * * *